US012778267B2

(12) United States Patent
Woodland et al.

(10) Patent No.: US 12,778,267 B2
(45) Date of Patent: Nov. 3, 2026

(54) ILLUMINATION DEVICE OF AT LEAST A STRAND OF KERATINIC FIBERS AND RELATED PROCESS

(71) Applicant: L'OREAL, Paris (FR)

(72) Inventors: Frédéric Woodland, Saint Ouen (FR); Gabin Vic, Saint Ouen (FR); Fabrice Osolin, Saint Ouen (FR)

(73) Assignee: L'OREAL, Paris (FR)

( * ) Notice: Subject to any disclaimer, the term of this patent is extended or adjusted under 35 U.S.C. 154(b) by 1276 days.

(21) Appl. No.: 17/601,560

(22) PCT Filed: Apr. 8, 2020

(86) PCT No.: PCT/EP2020/060027
§ 371 (c)(1),
(2) Date: Oct. 5, 2021

(87) PCT Pub. No.: WO2020/208077
PCT Pub. Date: Oct. 15, 2020

(65) Prior Publication Data

US 2022/0202167 A1 Jun. 30, 2022

(30) Foreign Application Priority Data

Apr. 9, 2019 (FR) ..... 19 03781

(51) Int. Cl.
*A45D 44/00* (2006.01)

(52) U.S. Cl.
CPC ..... *A45D 44/00* (2013.01); *A45D 2200/205* (2013.01)

(58) Field of Classification Search
CPC . A45D 2/001; A45D 2/00; A45D 2/36; A45D 2/362; A45D 2/12; A45D 2/38;
(Continued)

(56) References Cited

U.S. PATENT DOCUMENTS

2015/0173480 A1* 6/2015 Washington ..... A45D 7/06 206/581
2016/0324291 A1 11/2016 Fereyre et al.
(Continued)

FOREIGN PATENT DOCUMENTS

CN 105828657 A 8/2016
CN 106061316 A 10/2016
(Continued)

OTHER PUBLICATIONS

Clarivate Analytics copyrighted translation of KR-200406640-Y1; publication date Jan. 23, 2006 (Year: 2006).*
(Continued)

*Primary Examiner* — Edelmira Bosques
*Assistant Examiner* — Sarah Woodhouse
(74) *Attorney, Agent, or Firm* — POLSINELLI PC

(57) ABSTRACT

This device (110) includes a first branch (14) and a second branch (16). The first branch (14) and the second branch (16) are movable relative to one another between an open position for insertion of a lock (12) and a closed position for illumination of the lock (12) in which they define a cavity (20) for illumination of the lock (12), the cavity (20) opening by a first side slit and by a second side slit. The device (110) includes a first confinement member (80) extending in the first side slit over substantially the entire length of the first side slit and a second confinement member (82) extending in the second side slit over substantially the entire length of the second side slit. Each confinement member (80, 82) optically closes the illumination cavity (20) over its entire length when the device is in the closed position.

20 Claims, 9 Drawing Sheets

(58) Field of Classification Search
CPC . A45D 1/18; A45D 1/28; A45D 19/00; A45D 19/012; A45D 2200/205
See application file for complete search history.

(56) References Cited

U.S. PATENT DOCUMENTS

| | | | | |
|---|---|---|---|---|
| 2017/0181516 | A1 | 6/2017 | Washington et al. | |
| 2018/0213913 | A1 | 8/2018 | Fereyre et al. | |
| 2020/0397110 | A1* | 12/2020 | Fereyre | A45D 1/04 |

FOREIGN PATENT DOCUMENTS

| | | | |
|---|---|---|---|
| DE | 102012210272 | A1 | 12/2013 |
| EP | 3 216 368 | A1 | 9/2017 |
| JP | 2018520812 | A | 8/2018 |
| WO | 2013189786 | A1 | 12/2013 |
| WO | WO 2019/048357 | A1 | 3/2019 |

OTHER PUBLICATIONS

Clarivate Analytics copyrighted translation of EP2687118A2; publication date Jan. 22, 2014 (Year: 2014).*
Clarivate Analytics copyrighted translation of KR100404616B1; publication date Nov. 5, 2003 (Year: 2003).*

* cited by examiner

ILLUMINATION DEVICE OF AT LEAST A STRAND OF KERATINIC FIBERS AND RELATED PROCESS

CROSS REFERENCE TO RELATED APPLICATIONS

This application is a National Phase filing under 35 U.S.C. § 371 of PCT/EP2020/060027 filed on Apr. 8, 2020; which application in turn claims priority to Application No. 19 03781 filed in France on Apr. 9, 2019. The entire contents of each application are hereby incorporated by reference.

The present invention relates to an illumination device of at least a lock of keratinic fibers including:

- a first branch defining a first confinement surface;
- a second branch, defining a second confinement surface intended to be placed across from the first confinement surface, the first branch and the second branch being movable relative to one another between an open position for insertion of the lock and a closed position for illumination of the lock in which the confinement surfaces define a cavity for illumination of the lock;
- an assembly for illumination of the lock in the illumination cavity, able to illuminate the lock.

The device is in particular a movable clamp, intended to be used for the treatment of the hair. The treatment in particular aims to produce a discoloration of the hair, or to attach a sheath on the hair that withstands washing in order to give the hair a volume effect.

WO 2017/108767, WO 2004/054527 and WO 2007/04872 describe cosmetic sheathing compositions applicable on the hair. These compositions include photo-cross-linking compounds.

After application of the sheathing composition on the hair, an illumination device by light-emitting diodes (LED), emitting in the UV-Visible domain, is passed over the locks of hair to cross-link the photo-cross-linking compounds and thus to obtain the sheathing.

Generally, the emitted light is in the UV-visible domain, at energy doses on the order of the Joule/cm$^2$.

In other cases, when photo-oxidation must be done to discolor the hair, like in WO 2015/165949, hair treated by a composition comprising a chemical oxidizing agent is subject to the application of light with light-emitting diodes. An illuminating device producing higher intensity illuminations, for example on the order of around one hundred J/cm$^2$, is generally used.

The aforementioned illumination devices are very effective to offer effective radiation of the lock of hair.

However, there is still a need for improvement, in particular to protect the user from the light, in order to limit, or even avoid leaks of light during the radiation.

One aim of the invention is therefore to provide a device for illuminating at least one lock of keratinic fibers that makes it possible to perform treatments requiring an illumination of the lock, while greatly limiting, or even preventing the leaks of light outside the device.

Indeed, in the context of standard IEC 42471 relative to the photobiological safety of bulbs and apparatuses using bulbs, the aforementioned type of apparatus is classified among at-risk apparatuses (low—group 1 to high—group 3, depending on the nature of the measured risk). Such a classification then entails the respect for several regulatory constraints, in particular in terms of marking and prevention. It is thus desirable to be able to decrease the classification group of such an apparatus, or to allow it to be classified in group 0 (absence of risk), by implementing appropriate means.

To that end, the invention relates to an illumination device of at least one lock of keratinic fibers, including:

- a first branch defining a first confinement surface;
- a second branch, defining a second confinement surface intended to be placed across from the first confinement surface, the first branch and the second branch being movable relative to one another between an open position for insertion of the lock and a closed position for illumination of the lock in which the confinement surfaces define a cavity for illumination of the lock, the illumination cavity opening onto a first side edge of the illumination cavity by a first side slit for accessing the illumination cavity and onto a second opposite side edge of the illumination cavity by a second side slit for accessing the illumination cavity;
- an assembly for illumination of the lock in the illumination cavity, able to illuminate the lock with a light having a wavelength between 280 nm and 700 nm, in particular between 280 nm and 700 nm, characterized in that it includes:
- a first confinement member on the first side edge of the illumination cavity and coming from the first confinement surface, the second confinement surface, or their peripheries, the first confinement member extending in the first lateral slit over substantially the entire length of the first side slit,
  - a second confinement member, on the second side edge of the illumination cavity and coming from the first confinement surface, the second confinement surface or their peripheries, the second confinement member extending in the second lateral slit over substantially the entire length of the second side slit,
  - each confinement member optically closing the illumination cavity over its entire length when the device is in the closed position.

The illumination assembly is in particular configured to deliver an illumination power greater than 0.3 W/cm$^2$, or greater than 1 W/cm$^2$, in particular between 0.5 W/cm$^2$ and 5 W/cm$^2$. In applications requiring a high optical power, the illumination assembly is configured to deliver an illumination power greater than 20 W/cm$^2$, or greater than 30 W/cm$^2$.

"Optically closing" means that the confinement member allows less than 10%, preferably less than 1%, of the radiation emitted in the illumination cavity by the illumination system to pass toward the closing element, at the wavelengths emitted by the illumination system.

Very preferably, the optically closing nature allows a classification in group 0 (no risk), and at most in group 1 (low risk), of the apparatus.

The optical closing is for example measured by Standards IEC 62471:2006 and EN62471:2008.

The device according to the invention may include one or more of the following features, considered alone or according to any technically possible combination(s).

In a first variant, the confinement member comes from the periphery of one of the confinement surfaces from a side wall of one of the branches and/or the second confinement member comes from the periphery of one of the confinement surfaces from an opposite side wall of one of the branches.

In other words, the insertion points of the confinement members in question are not located on the confinement surfaces, but outside on the parts of the branches adjacent to these surfaces.

In a preferred second variant, the first confinement member comes from the first side edge of one of the confinement surfaces and/or the second confinement member comes from the opposite second side edge of one of the confinement surfaces.

In both variants, preferably, the first confinement member and the second confinement member come from the same branch.

In a first option, at least one of the two aforementioned confinement members is formed by a sheet of flexible material opaque to the UV/Visible rays, advantageously in the range between 200 nm and 800 nm.

By way of flexible materials, metallic sheets will be preferred, such as aluminum, or sheets made from plastic materials.

In a second preferred option, at least one of the two confinement members is formed from a curtain of bristles. Preferably, both confinement members are formed by curtains of bristles.

The curtain(s) of bristles can have one edge connected to the first branch or the second branch and a free edge, the free edge of the curtain of bristles bearing on the confinement surface of the other branch in the closed position.

The device can comprise one or several additional confinement members.

In particular, the device can comprise a first additional confinement member positioned opposite the first confinement member in the closed position.

It can also comprise a second additional confinement member positioned opposite the second confinement member in the closed position.

These additional confinement devices can extend over the entire length of the main confinement member. They can be formed by a recess defining a counter-form of the confinement member facing it. This further decreases the risk of light leakage.

Preferably in the closed position, the main confinement member extends in the recess forming the complementary confinement member without coming into contact with a bottom of the recess, a gap being defined in the recess between the main confinement member and the bottom of the recess. This guarantees an adequate circulation of the lock, while retaining excellent protection from the light.

The main confinement member can include a rounded edge or bead coming from the first confinement surface or the second confinement surface, toward the other confinement surface.

The main confinement member can comprise a relief protruding toward the other branch from the rounded edge or bead that, in the closed position, is positioned in contact with the other branch and keeps the rounded edge or bead separated from the other branch.

The invention also relates to a method for illumination of at least one lock of keratinic fibers including the following steps:

providing a device as previously described, the device being in an open position for insertion of the lock;

inserting a lock between the first branch and the second branch;

transitioning the device into the closed illumination position;

activating the illumination assembly in order to illuminate the lock with a light having a wavelength from 200 nm to 700 nm, advantageously from 280 nm to 700 nm; the first confinement member and the second confinement member bearing on the lock and respectively optically closing the illumination cavity over its entire length, performing a relative movement of the device with respect to the lock while keeping the device in the closed illumination position.

In a variant of this method, the lock is first treated with a cosmetic composition.

Preferably, this composition comprises:

a) at least one chemical oxidizing agent.

Preferably, the chemical oxidizing agent is hydrogen peroxide alone or in combination with at least one persalt, and in particular at least one persulfate.

Preferably, the composition comprising at least one chemical oxidizing agent comprises at least one alkaline agent. The alkaline agent(s) can be mineral or organic.

b) at least one photo-crosslinkable compound, and still more preferably photo-dimerizable.

Preferably, the photo-crosslinkable compound is a polymer. Still more preferably, the photo-crosslinkable polymer is a hydrophobized or non-hydrophobized PVA-SBQ.

The cosmetic composition comprising the chemical oxidizing agent(s) and/or the photo-crosslinkable compound(s) can also comprise at least one compound chosen from among solvents, fatty bodies that may or may not be siliconized, anionic, cationic, non-ionic or amphoteric surfactants, which may or may not be siliconized, non-photo-crosslinkable polymers, and in particular anionic, cationic, non-ionic or amphoteric treating, fixing or thickening polymers, synthetic or natural soluble coloring agents, pigments, agents breaking disulfide bonds, oxidizing agents, and anti-dandruff agents, loss prevention agents.

The composition applied on the hair in the inventive methods can result from mixing during the use of at least two compositions. This is in particular the case for bleaching, where the cosmetic composition applied on the hair preferably results from mixing at the time of the use of two compositions, one of which contains hydrogen peroxide or a hydrogen peroxide precursor, the second composition containing at least one alkaline agent. Still more preferably, the first composition is aqueous and contains hydrogen peroxide, and the second composition is anhydrous.

The keratinic fibers are preferably human hairs or extensions.

The invention will be better understood upon reading the following description, provided solely as an example, and in reference to the appended drawings, in which.

Figure 1:
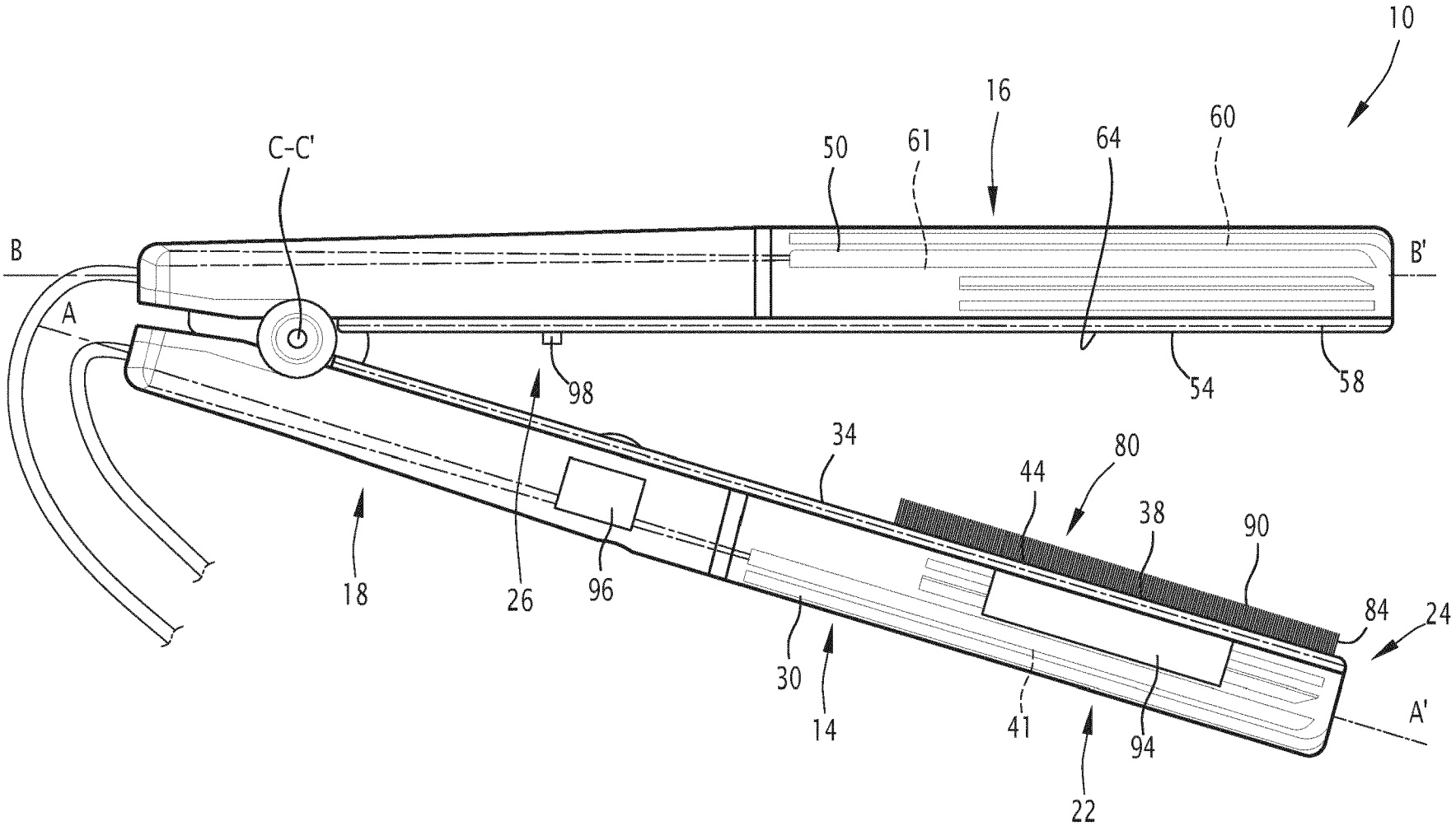
FIG. 1 is a side view of a first illumination device according to the invention.
Figure 2:
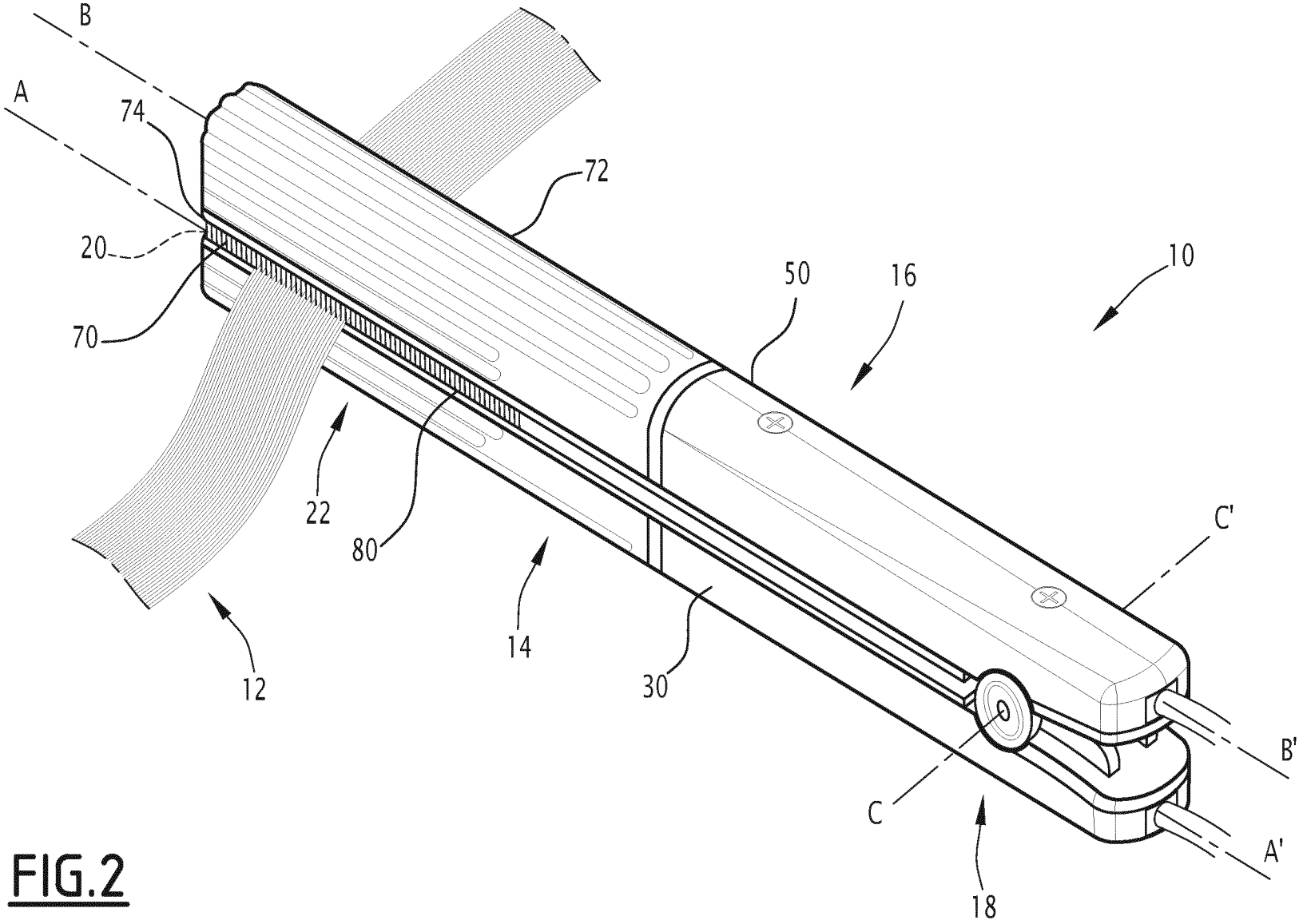
FIG. 2 is a three-quarters front perspective view of the device of FIG. 1, during the illumination of a lock of hair.
Figure 3:
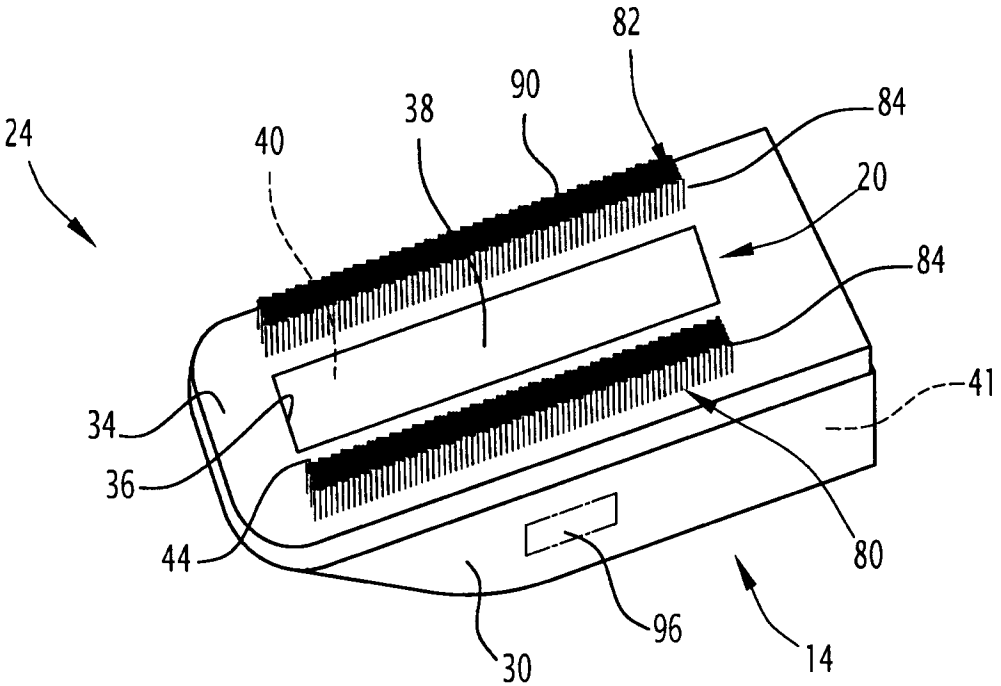
FIG. 3 is a top view of a detail of a branch of the device of FIG. 1.

A first illumination device 10 of a lock of hair 12 according to the invention is illustrated in FIGS. 1 and 2.

The device 10 here is a clamp. It is intended to illuminate the lock of hair 12 in order for example to treat a lock of hair on which a cosmetic composition has previously been applied.

The cosmetic composition advantageously contains at least one photo-crosslinkable compound that cross-links during the treatment by illumination of the lock in the device 10.

In a variant, the device 10 is intended to illuminate the lock of hair 12 in order to photo-oxidize the lock, and to cause a discoloration. In this use, it is also possible to treat, by illumination, a lock previously treated with a cosmetic composition comprising at least one chemical oxidizing agent.

In reference to FIGS. 1 to 4, the illumination device 10 includes a first branch 14 and a second branch 16, the branches 14, 16 being mounted movably relative to one another, between an open position for introducing the lock 12 into the device 10, visible in FIG. 1, and a closed position for confining the lock 12 defining an illumination cavity 20, visible in FIG. 2.

The device 10 further includes an assembly 18 for articulating the first branch 14 with the second branch 16 and an assembly 22 for illuminating the lock 12 in the illumination cavity 20.

According to the invention, the device 10 comprises a confinement assembly 24 of the light in the illumination cavity 20 and, advantageously, a securing system 26.

The first branch 14 extends along a longitudinal axis A-A'. In this example, it includes a hollow shell 30, a support frame 32 contained in the hollow shell 30 (visible in FIG. 4) and a closing plate 34 delimiting a window 36.

The first branch 14 further includes a glass 38 positioned in the window 36 and a reflector 40 positioned in the hollow shell 30 across from the glass 38.

The hollow shell 30 inwardly delimits a housing 41 emerging toward the second branch 16.

Figure 4:
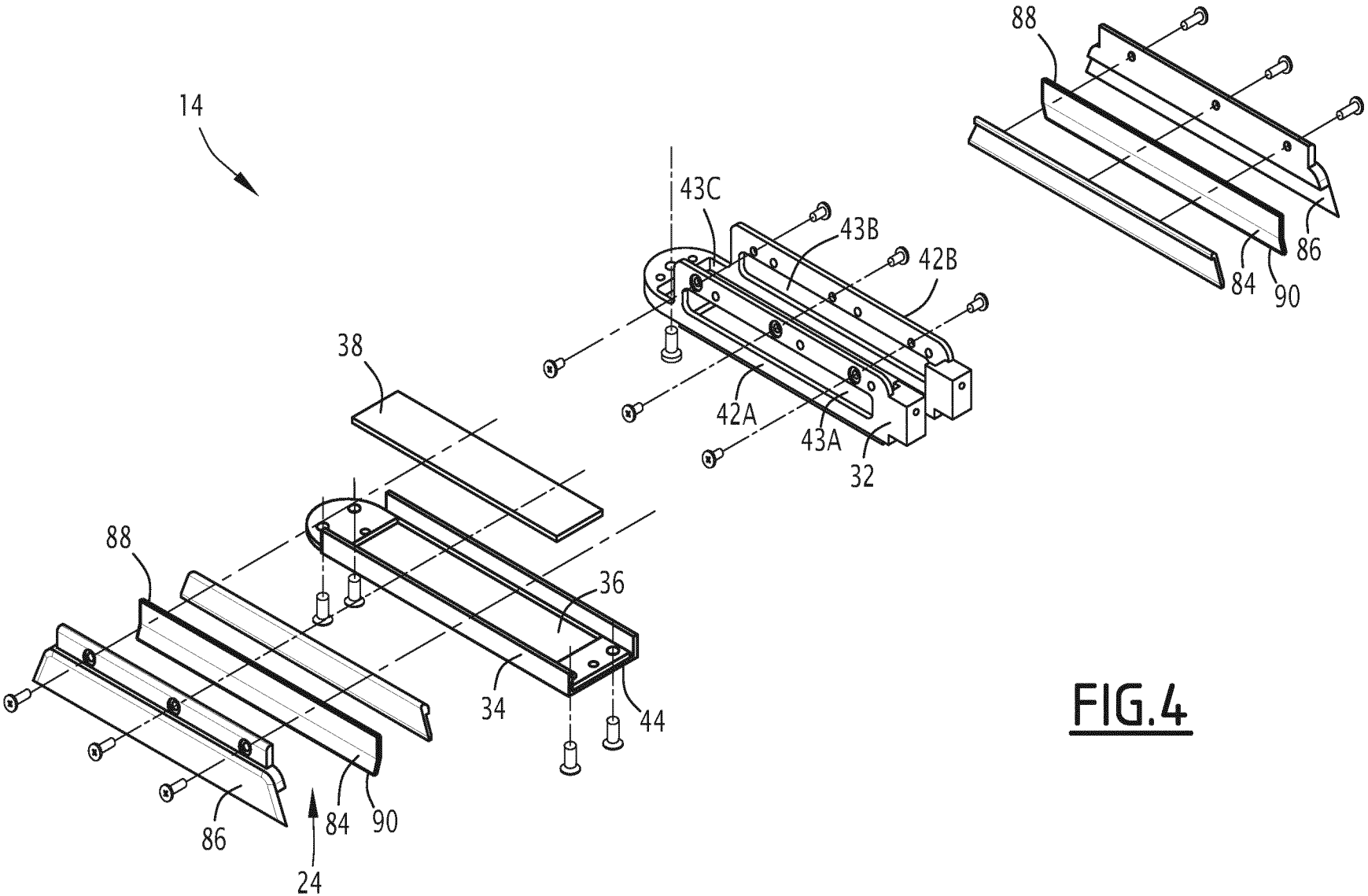
FIG. 4 is an exploded perspective view of the relevant components of the branch of FIG. 3.

In reference to FIG. 4, the support frame 32 includes two side walls 42A, 42B extending longitudinally in the housing 41 of the hollow shell 30.

The support frame 32 is open-worked. It has, through the side walls 42A, 42B, assembly openings 43A, 43B. It defines, between the side walls 42A, 42B, an upper opening 43C extending across from the window 36.

The closing plate 34 closes the hollow shell 30 toward the second branch 16.

In this example, the glass 38 is flush with the plate 34 at the window 36. The glass 38 and the plate 34 together define a first confinement surface 44 of the lock 12 delimiting a first side of the illumination cavity 20.

The second branch 16 extends along a longitudinal axis B-B'. In this example, it also includes a hollow shell 50, and a closing plate 54 delimiting a window 56.

The second branch 16 also includes a glass 58 positioned in the window 56 and a reflector 60 positioned in the hollow shell 50 across from the glass 58.

The hollow shell 50 inwardly delimits a housing 61 emerging toward the first branch 14.

The closing plate 54 closes the hollow shell 50 toward the first branch 14.

In this example, the glass 58 is flush with the plate 54 at the window 56. The glass 58 and the plate 54 together define a second confinement surface 64 of the lock 12 delimiting a second side of the illumination cavity 20.

In this example, the first branch 14 and the second branch 16 are mounted movably relative to one another in rotation, by means of the articulation assembly 18 between the open position and the closed position. The rotation is done about an axis C-C' perpendicular to the longitudinal axis A-A', B-B' of each branch 14, 16.

In the open position of the device 10, visible in FIG. 1, the first branch 14 is partially moved away from the second branch 16. The volume of the intermediate space between the branches 14, 16, taken between the first confinement surface 44 and the second confinement surface 64, is maximal to allow an easy introduction of the lock 12 between the branches 14, 16.

In the closed position of the device 10, visible in FIG. 2, the first branch 14 and the second branch 16 are brought closer to one another in order to place their longitudinal axes A-A' and B-B' substantially parallel to one another.

The first confinement surface 44 and the second confinement surface 64 are then located across from one another. The volume of the intermediate space between the branches 14, 16, taken between the first confinement surface 44 and the second confinement surface 64, is minimal.

When the device 10 is in the closed position, the illumination cavity 20 emerges laterally on either side of the longitudinal axis A-A', B-B' of each branch 14, 16, between the branches 14, 16, by a first side slit 70 and by a second side slit 72.

The illumination cavity 20 also emerges axially at the free end of each branch 14, 16, opposite the articulation assembly 18, by an axial passage 74.

The length of each side slit 70, 72 is smaller than the length of each branch 14, 16 and is for example between 10% and 60% of the length of each branch 14, 16. The height of each sideslip 70, 72 is less than 30 mm.

The confinement assembly 24 includes a first confinement member 80, positioned in the first side slit 70 in order to close the first side slit 70 in the closed position, and a second confinement member 82, positioned in the second side slit 72 in order to close the second side slit 72 in the closed position.

In the example illustrated in FIGS. 1 to 4, the first confinement member 80 and the second confinement member 82 are carried by the first branch 14. The first confinement member 80 and the second confinement member 82 here protrude from the first confinement surface 44 on the first branch 14 toward the second confinement surface 64 on the second branch 76.

Each confinement member 80, 82 extends over substantially the entire length of the side slit 70, 72, advantageously over a length greater than 90%, better greater than 95% of the length of the side slit 70, 72.

Furthermore, each confinement member 80, 82 includes a height, taken from the first confinement surface 44, greater than or equal to the height of each side slit 70, 72.

In this example, each confinement member 80, 82 includes a curtain of bristles 84 and an attachment member 86 of the curtain of bristles 84 on the first branch 14, visible in FIG. 4.

The curtain of bristles 84 is optically closing. It has a plurality of adjacent rows of bristles oriented transversely and preferably substantially perpendicular relative to the longitudinal axis A-A' of the branch 14. Each bristle of the curtain of bristles 84 is in contact with other bristles.

The curtain of bristles 84 has a thickness greater than the thickness of each individual bristle, advantageously greater than at least three times the thickness of each individual bristle.

In this example, the curtain of bristles 84 advantageously has a thickness from 1 mm to 15 mm, better from 2 mm to 10 mm.

The curtain of bristles 84 includes an edge 88 connected to the first branch 14, and a free edge 90 intended to come into contact with the second confinement surface 64 in the closed position of the device 10.

In the example shown in FIG. 4, the attachment member 86 is formed by an attachment plate, mounted on a respective side wall 42A, 42B of the frame 32 in order to grip the curtain of bristles 84 between the side wall 42A, 42B and the attachment member 86.

The illumination assembly 22 includes at least one light source 94, and at least one controller 96 of the operation of the or each light source 94.

The light source 94 is mounted in the housing 41, 51 of a shell 30, 50, for example in the housing 41 of the shell 30 of the first branch 14.

The light source 94 is for example formed by at least one light-emitting diode, preferably by a group of light-emitting diodes.

The light source 94 is able to be powered by the controller 96 from a power source (not shown) in order to illuminate the lock 12 through the glass 38. The power source is for example at least one battery contained in the device 10 or a cord coupled to the power supply from the sector.

The illumination produced by the light source 94 is preferably produced in the range of wavelengths from 200 nm to 700 nm, better from 280 nm to 700 nm.

Advantageously, the light source 94 is able to develop a light intensity of between 1 $J/cm^2$ and 5000 $J/cm^2$.

In order to perform photo-crosslinking operations on the lock 12, the light intensity is preferably between 500 $mJ/cm^2$ and 10 $J/cm^2$.

During bleaching operations on the lock 12, the light intensity is preferably between 1 $J/cm^2$ and 5000 $J/cm^2$, in particular between 100 $J/cm^2$ and 5000 $J/cm^2$.

In this example, the securing system 26 includes a member 98 mounted movably in the first branch 14 between an idle deployed position, when the device 10 is in its open position, and a retracted secure position, when the device 10 is in its closed position.

The movable member 98 is kept in the retracted secure position by gripping between the first branch 14 and the second branch 16, in the closed portion of the device 10.

The controller 96 is able to illuminate the light source 94 only when the movable member 98 of the securing system 26 is in its retracted position.

The operation of the illumination device 10 will now be described.

Initially, the user places the device 10 in the open position and grasps a lock 12 of hair intended to undergo an illumination. The lock 12 can be coated beforehand with a cosmetic composition for example containing at least one chemical oxidizing agent and/or at least one photo-crosslinkable compound.

The user then inserts the lock 12 between the first branch 14 and the second branch 16 across from the confinement surfaces 44, 64.

Then, he transitions the device 10 to its closed position by bringing the first branch 14 and the second branch 16 closer to one another.

During this approach, the first confinement surface 44 is placed across from the second confinement surface 64 in order to close the illumination cavity 20.

The curtains of bristles 84 of each confinement member 80, 82 close the side slits 70, 72 by bearing on the second confinement surface 64 from the first confinement surface 44, and pinching the hairs of the lock 12, as shown in FIG. 2.

In particular, the curtain of bristles 84 being deformable, it adapts to the shape of the lock 12 of hair. The hairs of the lock 12 are advantageously inserted between the bristles of the curtain of bristles 84 in order to ensure near-total confinement of the side slits 70, 72, either by the bristles of the curtain of bristles 84, or by the hairs of the lock 12.

The lateral confinement of the illumination cavity 20 is therefore near-total, which decreases the risk of exposure of the user to the light created in the cavity 20.

The movable member 98 of the securing system is gripped between the branches 14, 16 and therefore occupies its retracted position.

The user then activates the light source 94. The controller 96 controls the source 94 to apply the desired illumination on the lock 12. Advantageously, the user moves the device 10 along the lock 12 to treat it over a chosen length. Then, he opens the device 10 again to remove the block 12 and optionally to place another lock 12 between the branches 14, 16.

In a variant (not shown) of the first illumination device 110, at least one of the two confinement members 80, 82 is formed by a sheet of flexible material opaque to the UV/Visible rays, advantageously in the range between 200 nm and 800 nm.

By way of flexible materials, metallic sheets will be preferred, such as aluminum, or sheets made from plastic materials.

Figure 5:
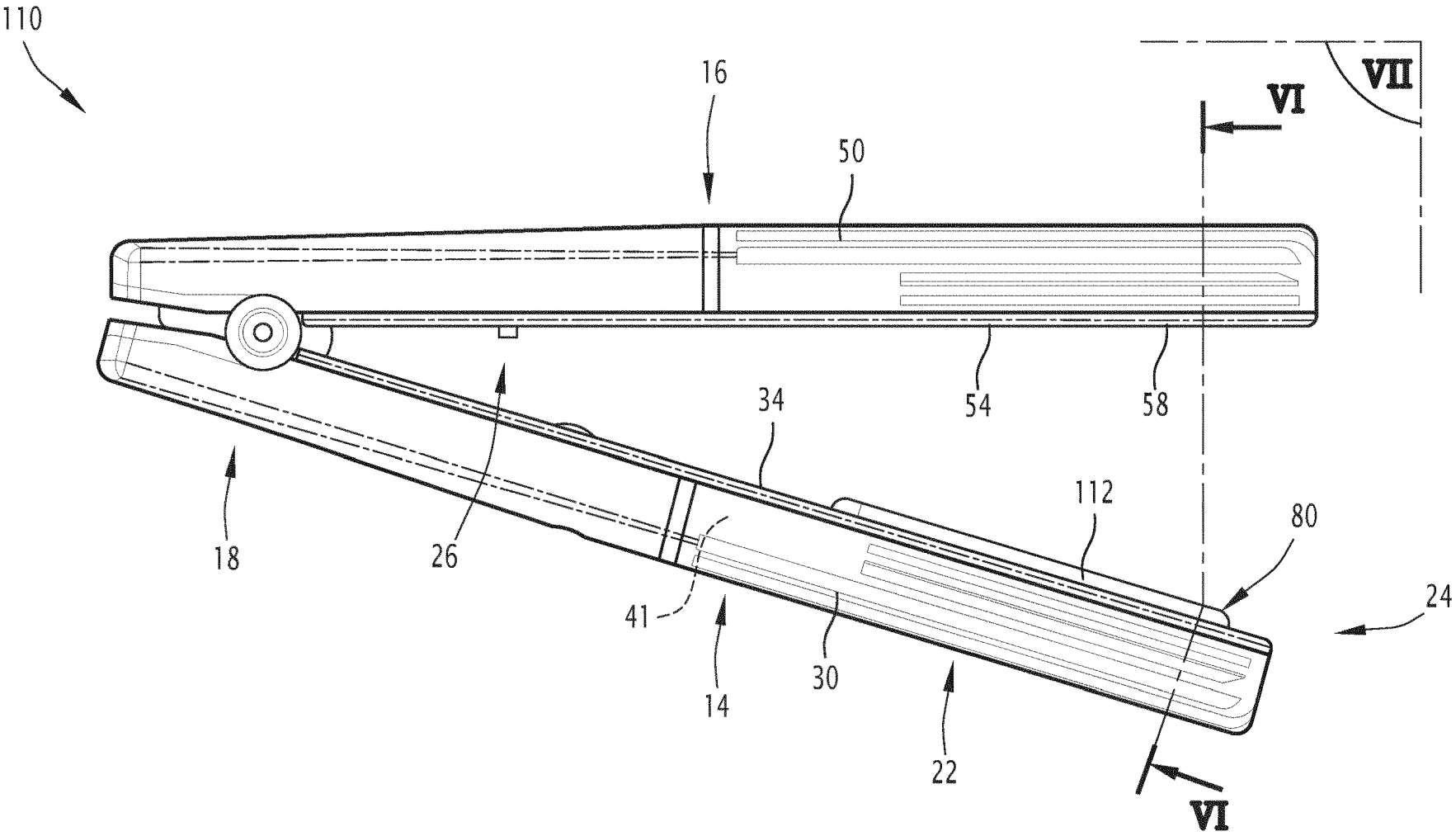
FIG. 5 is a view similar to FIG. 1 of a second device according to the invention.
Figure 6:
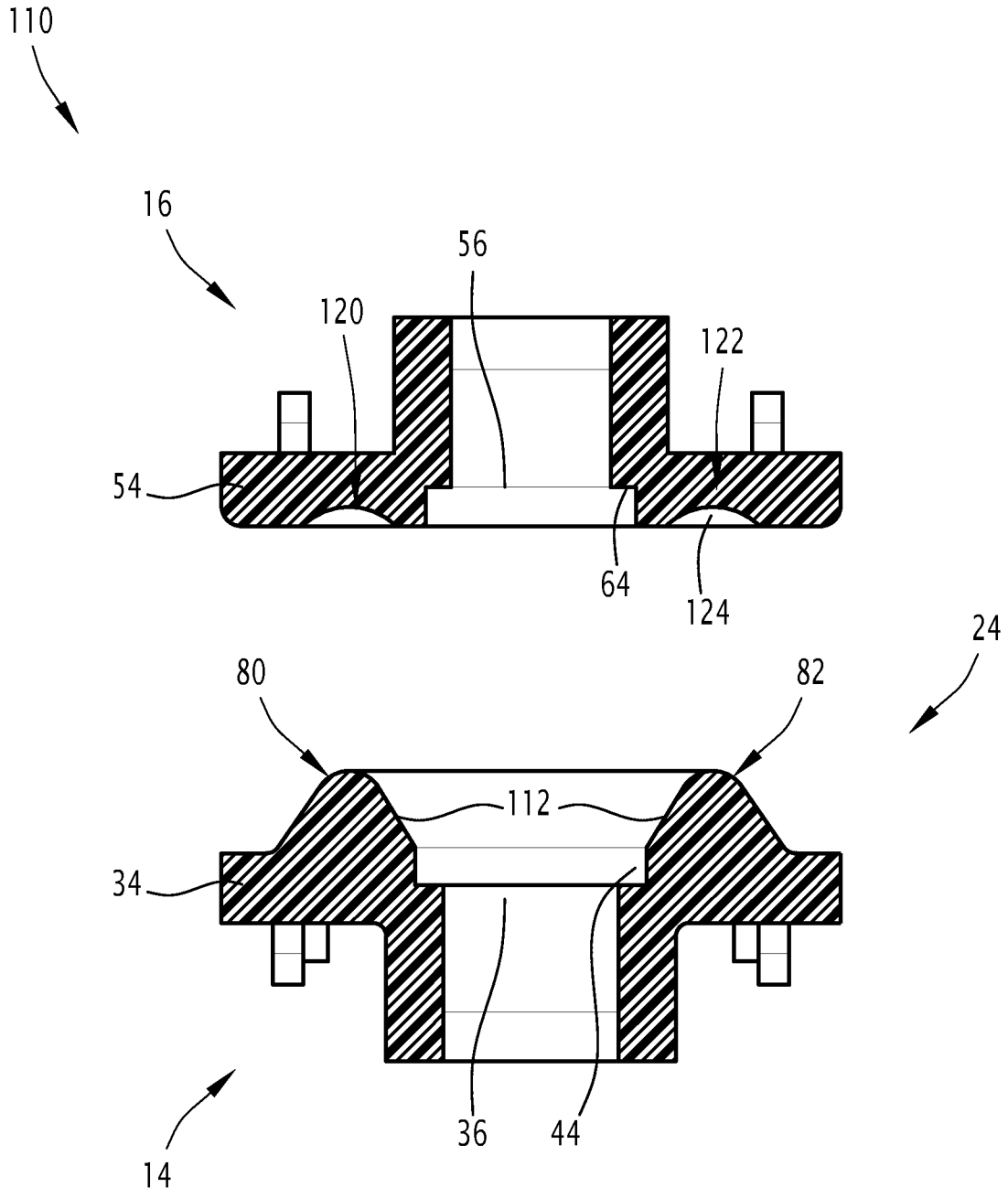
FIG. 6 is a sectional view, in a transverse plane VI of FIG. 5.
Figure 7:
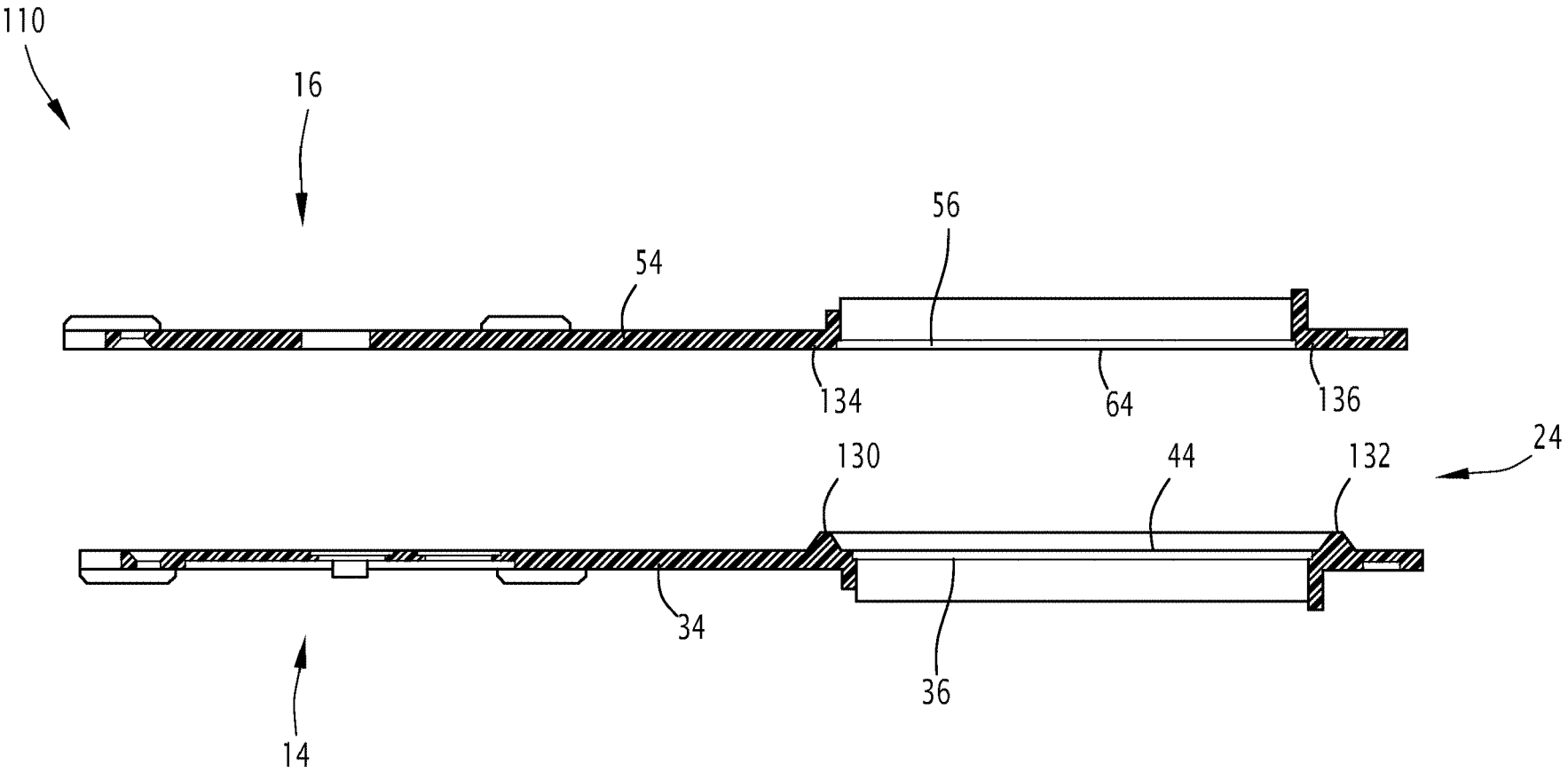
FIG. 7 is a sectional view along the median axial plane VII of FIG. 5.

A second illumination device 110 is illustrated in FIGS. 5 to 7. The second device 110 differs from the first device 10 by the structure of the confinement members 80, 82.

In this example, each confinement member 80, 82 is formed by a solid longitudinal rounded edge or bead 112, protruding from the first confinement surface 44 toward the second confinement surface 64.

The rounded edge or bead 112 is elongated parallel to the axis of the branch 14, 16. It preferably has a curved outer surface.

The width of the rounded edge or bead 112 considered transversely relative to the longitudinal axis A-A' of the branch 14, is less than at least twice, preferably at least four times its length.

The rounded edge or bead 112 advantageously forms a body with the closing plate 34, as illustrated in FIG. 6. In this example, it has a pyramidal cross-section.

Furthermore, the device 110 includes, for each main confinement member 80, 82, a complementary confinement member 120, 122, present on the second confinement surface 64, across from each confinement member 80, 82.

In this example, each complementary confinement member 120, 122 is formed by a recess in the form of a groove 124, with a length substantially equal to the length of the rounded edge or bead 112 and constituting a counter-form of the rounded edge or bead 112.

Figure 8:
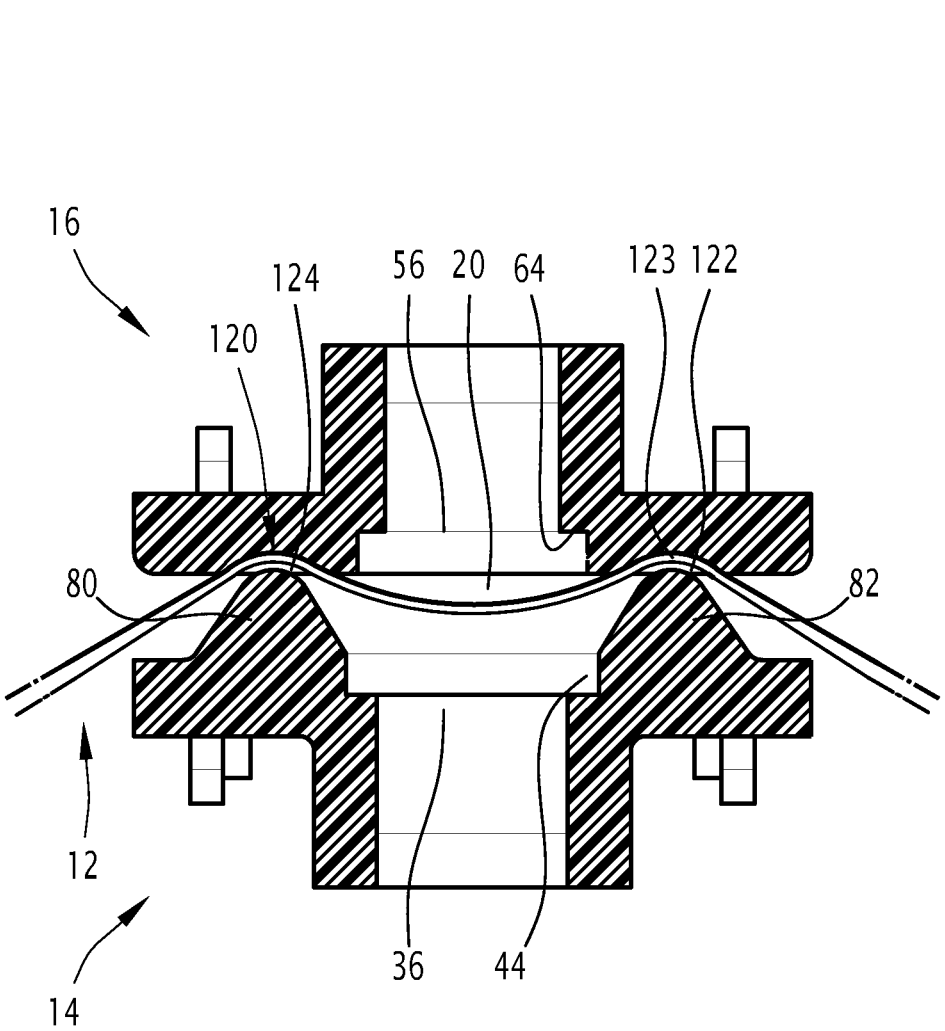
FIG. 8 is a view similar to FIG. 6 in the closed position of the second device according to the invention.

In the closed position of the device 10 as illustrated by FIG. 8, the rounded edge or bead 112 protrudes in the groove 124, advantageously without contact with the bottom of the groove 124, while delimiting a gap 123 located between the apex of the rounded edge or bead 112 and the bottom of the groove 124.

Advantageously, the device 110 further includes a first axial confinement member 130 positioned between longitudinal ends of the confinement members 80, 82 and a second axial confinement member 132 that extends between the opposite longitudinal ends of the confinement members 80, 82.

Each axial confinement member 130, 132 is also formed by a rounded edge or bead that protrudes relative to the first confinement surface 44.

The confinement members 80, 82, 130, 132 preferably define a continuous closed contour at the periphery of the illumination cavity 20 on the first plate 34.

Likewise, each axial confinement member 130, 132 is advantageously positioned across from a complementary axial confinement member 134, 136 arranged in the second confinement surface 64.

Each complementary axial confinement member 134, 136 is also formed by a recess in the form of a groove.

The complementary first axial confinement member 134 is positioned between longitudinal ends of the axial confinement members 130, 132 and the complementary second axial confinement member 132 extends between the opposite longitudinal ends of the axial confinement members 130, 132.

The groove then extends continuously over a contour of the illumination cavity 20. Thus, the illumination cavity 20 is closed off not only in the side slits 70, 72, but also in the axial passage 74.

During operation, the locks 12 are inserted into the gap 123 between each confinement member 80, 82 and the complementary confinement member 120, 122 facing it.

In light of the partial insertion of the confinement member 80, 82 into the complementary confinement member 120, 122, the illumination cavity 20 is closed off, while allowing the lock 12 to circulate through each gap 123 between a confinement member 80, 82 and the complementary confinement member 120, 122 receiving the confinement member 80, 82.

The use of a form/counter-form system illustrated in FIGS. 6 to 8 is therefore particularly advantageous, since it ensures maximum security, without hindering the circulation of the lock 12.

Figure 9:
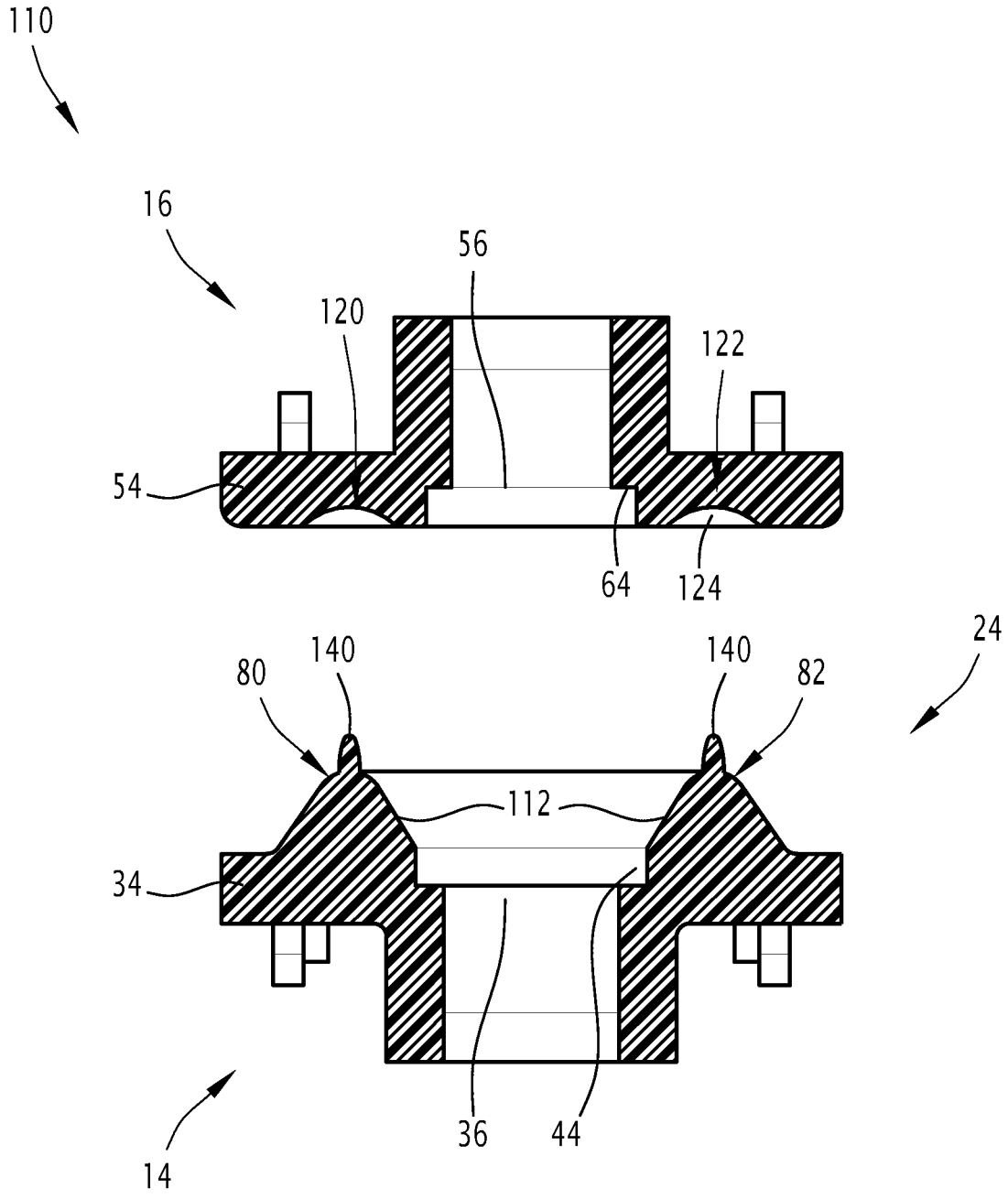
FIG. 9 is a view similar to FIG. 6 of a variant of the second device according to the invention.

In a variant, shown in FIG. 9, a relief 140 for defining the height of the gap 123 is provided. The relief 140 for example protrudes from the apex of the rounded edge or bead 122 to cooperate with the bottom of the groove 124 across from it in the closed position of the device 10. It has a length smaller than that of the rounded edge or bead 112.

In a variant of the preceding embodiments, at least one confinement member 80, 82 is carried by the second branch 16 and protrudes from the second confinement surface 64 toward the first confinement surface 44.

In another variant, at least one confinement member 80, 82 comes from the periphery of the confinement surface 44, 64, and not from the confinement surface 44, 64 itself.

The invention claimed is:

1. An illumination device for illuminating at least one lock of keratinic fibers, including:

a first branch defining a first confinement surface;

a second branch, defining a second confinement surface configured to be placed across from the first confinement surface, the first branch and the second branch being movable relative to one another between an open position for insertion of the at least one lock of keratinic fibers and a closed position for illumination of the at least one lock of keratinic fibers in which the first and second confinement surfaces define a cavity for illumination of the at least one lock of keratinic fibers, the illumination cavity opening onto a first side edge of the illumination cavity by a first side slit for accessing the illumination cavity and onto a second opposite side edge of the illumination cavity, by a second side slit for accessing the illumination cavity;

an assembly for illumination of the at least one lock of keratinic fibers in the illumination cavity, configured to illuminate the at least one lock of keratinic fibers, the assembly for Illumination comprising a light having a wavelength between 200 nm and 700 nm, wherein:

a first confinement member is disposed on the first side edge of the illumination cavity and coming from the first confinement surface, the second confinement surface, or their peripheries, the first confinement member extending in the first side slit over substantially the entire length of the first side slit, a second confinement member is disposed on the second side edge of the illumination cavity and coming from the first confinement surface, the second confinement surface, or their peripheries, the second confinement member extending in the second side slit over substantially the entire length of the second side slit, each confinement member optically closing the illumination cavity over its entire length when the device is in the closed position, wherein the first confinement member and/or the second confinement member is formed by a deformable curtain of bristles, wherein the curtain of bristles has one edge connected to the first branch or the second branch and a free edge, the free edge of the curtain of bristles bearing on the confinement surface of the other branch in the closed position, wherein the curtain of bristles is optically closing and has a plurality of adjacent rows of bristles oriented transversely and substantially perpendicular relative to the longitudinal axis of the branch, each bristle of the curtain of bristles is in contact with other bristles, the curtain of bristles having a thickness greater than the thickness of each individual bristle.

2. The device according to claim 1, wherein the first confinement member comes from the periphery of one of the first and second confinement surfaces, from a side wall of one of the branches and/or the second confinement member comes from the periphery of one of the confinement surfaces from an opposite side wall of one of the branches.

3. The device according to claim 2, including a first additional confinement member positioned opposite the first confinement member in the closed position.

4. The device according to claim 1, wherein the first confinement member comes from the first confinement surface and/or the second confinement member comes from the opposite second confinement surfaces.

5. The device according to 1, wherein the first confinement member and the second confinement member come from the same branch.

6. The device according to claim 1, wherein the curtain of bristles has one edge connected to the first branch or the second branch and a free edge, the free edge of the curtain of bristles bearing on the confinement surface of the other branch in the closed position.

7. The device according to 1, including a first additional confinement member positioned opposite the first confinement member in the closed position.

8. The device according to claim 7, including a second additional confinement member positioned opposite the second confinement member in the closed position.

9. The device according to claim 7, wherein the first additional confinement member extends over the entire length of the first confinement member.

10. The device according to claim 1, wherein either the first confinement member or the second confinement member is formed by the deformable curtain of bristles and a remaining one of the first and second confinement members is a sheet of flexible material opaque to the light.

11. A method for illumination of at least one lock of keratinic fibers including the following steps:

providing a device according to claim 1, the device being in an open position for insertion of the at least one lock of keratinic fibers;

inserting a lock of keratinic fibers between the first branch and the second branch;

transitioning the device into the closed position for illumination;

activating the illumination assembly in order to illuminate the lock of keratinic fibers with a light having a wavelength from 200 nm to 700 nm; the first confinement member and the second confinement member bearing on the lock of keratinic fibers and optically closing the illumination cavity over its entire length, performing a relative movement of the device with respect to the lock of keratinic fibers while keeping the device in the closed illumination position.

12. The method according to claim 11, wherein the lock is treated beforehand with a cosmetic composition.

13. The device according to claim 1, wherein the curtain of bristles has a thickness greater than at least three times the thickness of each individual bristle.

14. An illumination device for illuminating at least one lock of keratinic fibers, including:

a first branch defining a first confinement surface;

a second branch, defining a second confinement surface configured to be placed across from the first confinement surface, the first branch and the second branch being movable relative to one another between an open position for insertion of the at least one lock of keratinic fibers and a closed position for illumination of the at least one lock of keratinic fibers in which the confinement surfaces define an illumination cavity for illumination of the at least one lock of keratinic fibers, the illumination cavity opening onto a first side edge of the illumination cavity by a first side slit for accessing the illumination cavity and onto a second opposite side edge of the illumination cavity, opposite the first side edge, by a second side slit for accessing the illumination cavity;

an assembly for illumination of the at least one lock of keratinic fibers in the illumination cavity, configured to illuminate the at least one lock of keratinic fibers, the assembly for illumination comprising a light having a wavelength between 200 nm and 700 nm, wherein:

a first confinement member is disposed on the first side edge of the illumination cavity and coming from the first confinement surface, the second confinement surface, or their peripheries, the first confinement member extending in the first side slit over substantially the entire length of the first side slit, a second confinement member is disposed on the second side edge of the illumination cavity and coming from the first confinement surface, the second confinement surface, or their peripheries, the second confinement member extending in the second side slit over substantially the entire length of the second side slit, each confinement member optically closing the illumination cavity over its entire length when the device is in the closed position, wherein at least one of the confinement members is formed by a sheet of flexible material opaque to the light.

15. An illumination device for illuminating at least one lock of keratinic fibers, including:

a first branch defining a first confinement surface;

a second branch, defining a second confinement surface configured to be placed across from the first confinement surface, the first branch and the second branch being movable relative to one another between an open position for insertion of the at least one lock of keratinic fibers and a closed position for illumination of the at least one lock of keratinic fibers in which the confinement surfaces define a cavity for illumination of the at least one lock of keratinic fibers, the illumination cavity opening onto a first side edge of the illumination cavity by a first side slit for accessing the illumination cavity and onto a second opposite side edge of the illumination cavity, opposite the first edge side, by a second side slit for accessing the illumination cavity;

an assembly for illumination of the at least one lock of keratinic fibers in the illumination cavity, configured to illuminate the at least one lock of keratinic fibers, the assembly for illumination comprising a light having a wavelength between 200 nm and 700 nm, wherein:

a first confinement member is disposed on the first side edge of the illumination cavity and coming from the first confinement surface, the second confinement surface, or their peripheries, the first confinement member extending in the first side slit over substantially the entire length of the first side slit, a second confinement member is disposed on the second side edge of the illumination cavity and coming from the first confinement surface, the second confinement surface, or their peripheries, the second confinement member extending in the second side slit over substantially the entire length of the second side slit, each confinement member optically closing the illumination cavity over its entire length when the device is in the closed position, wherein the first confinement member includes a rounded edge or bead coming from the first confinement surface or the second confinement surface, toward the other confinement surface, and wherein the first confinement member comprises a relief protruding toward the other branch from the rounded edge or bead, and wherein, in the closed position, the relief is positioned in contact with the other branch and keeps the rounded edge or bead separated from the other branch.

16. The device according to claim 15, further comprising a first additional confinement member positioned opposite the first confinement member in the closed position, and wherein the first additional confinement member is formed by a recess defining a counter-form of the confinement member facing it.

17. The device according to claim 16, wherein, in the closed position, the first confinement member extends in the recess forming the first additional confinement member without coming into contact with a bottom of the recess, a gap being defined in the recess between the first confinement member and the bottom of the recess.

18. The device according to claim 15, wherein the second confinement member comprises a rounded edge or bead coming from the second confinement surface, toward the first confinement surface.

19. The device according to claim 18, wherein the first confinement member comprises a relief protruding toward the other branch from the rounded edge or bead, and wherein, in the closed position, the relief is positioned in contact with the other branch and keeps the rounded edge or bead separated from the other branch.

20. The device according to claim 15, wherein the rounded edge or bead defines a substantially flat surface from which the relief protrudes.

* * * * *